United States Patent [19]

Cusimano

[11] Patent Number: 4,540,378

[45] Date of Patent: Sep. 10, 1985

[54] STUFFED FIGURE HAVING POSITIONABLE ARMS

[76] Inventor: Sharon I. Cusimano, 2537 W. 50th St., Chicago, Ill. 60632

[21] Appl. No.: 676,305

[22] Filed: Nov. 29, 1984

[51] Int. Cl.[3] ..... A63H 3/02

[52] U.S. Cl. ..... 446/369; 446/376; 446/390

[58] Field of Search ..... 446/369, 371, 376, 390, 446/268, 370, 382

[56] References Cited

U.S. PATENT DOCUMENTS

| | | | |
|---|---|---|---|
| 1,388,677 | 8/1921 | Weatherly | 446/369 |
| 1,659,720 | 2/1928 | Cate | 446/369 |
| 3,930,331 | 1/1976 | Simeone | 446/369 |
| 3,977,121 | 8/1976 | Goldfarb et al. | 446/369 |
| 4,197,670 | 4/1980 | Cox | 446/369 |

*Primary Examiner*—Robert A. Hafer
*Assistant Examiner*—Daniel Nolan
*Attorney, Agent, or Firm*—Edward D. Gilhooly

[57] ABSTRACT

A stuffed ornamental figure in the shape of a character, either real or fictitious, or an animal having a one piece body and an elongated arm which attaches at its center portion to the body. The arm is capable of assuming a position to encircle the body in a hugging gesture, to extend at selected angles from the body, or to encircle an object for display purposes. The body carries a head of a soft sculpture design and a face depicting the selected character.

3 Claims, 3 Drawing Figures

2
4
6
8
10
12
14
16
18
20
22
30

STUFFED FIGURE HAVING POSITIONABLE ARMS

BACKGROUND OF THE INVENTION

This invention relates to a novel stuffed figure and, in particular, to a figure providing an attractive aesthetic character and being capable of standing by itself or in conjunction with other objects for aesthetic and functional purposes.

Many designs of novelty items in the form of stuffed animals, humanized characters, and the like have been provided for hundreds of years. None of these prior creations have combined the advantages of an inexpensive and easily fabricated figure with the desirable attributes of standing by itself or in conjunction with other objects in a unique manner. Some of these figures in the past have required stands or attachment elements to be maintained upright by themselves or in conjunction with another object.

The invention of the application provides an attractive figure in the form of a human of any selected design, such as, for example, a Santa Claus or other representations of persons, characters or animals having arm-like features. The figure of the invention is in the form of stuffed body parts interconnected to create the illusion of a figure. The figure is formed with elongated arms which serve several purposes, namely to attain a self hugging-like gesture, to extend from the body in any orientation, or to encircle an object for display purposes. In all situations, the figure is capable of maintaining an upright position without external support. The invention of the application provides an easy to manufacture and unique novelty item which combines functionality with artistic considerations.

DESCRIPTION OF A PREFERRED EMBODIMENT

Figures 1, 2, 3:
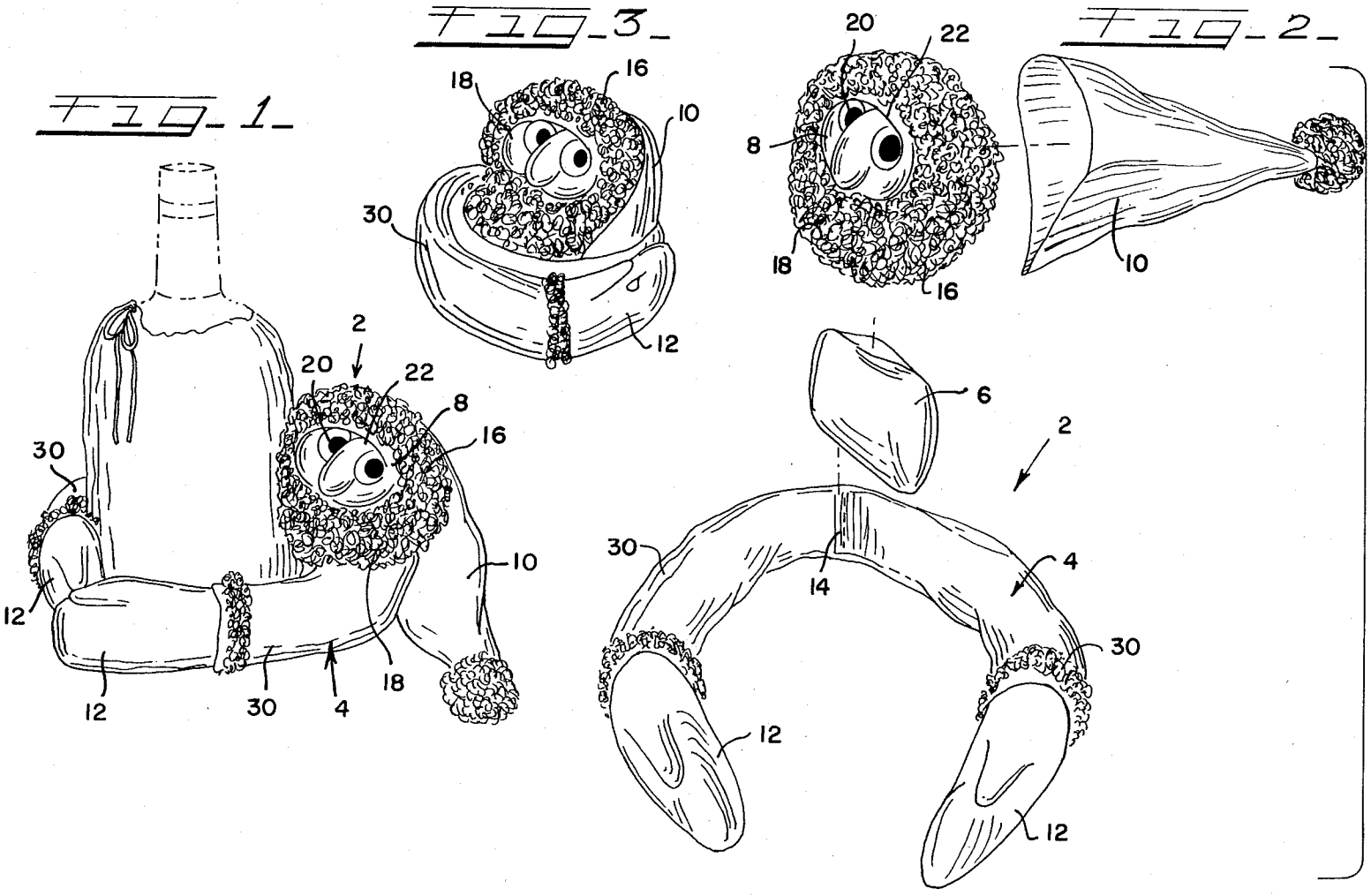
FIG. 1 is a perspective illustration of the stuffed figure of the invention in association with an article.
FIG. 2 is a front perspective view, with exploded parts, of the stuffed figure of FIG. 1.
FIG. 3 is a top schematic view of the stuffed figure invention in a self hugging configuration.

Referring to the drawings, there is illustrated the stuffed FIG. 2 of the invention illustrated as a simulation of Santa Claus and generally designated by reference numeral 2. It is within the scope of the invention to depict any character, fictitious or a real person, or an animal, where appropriate, to accomplish the objectives of the invention. Basically, stuffed FIG. 2 includes an elongated arm structure 4, a body portion 6, and a head 8, on which a cap 10 or other element can be affixed. The arm structure 4 is a soft, stuffed body having an outer cover of polyester fiber and the like, which is stuffed with any type of preferably soft material. The arm structure 4 may be stitched along its length to form a completed body encasing the internal material and hand-like features 12 may be affixed to each end of the arm member. The arm is affixed along a vertical stitching 14 of thread to one end of the body 6 at an area of the arm where stuffing material is not present. In FIG. 2, the body is shown as having a cushion-type rectangular shape, although the body may be a cylindrical shape, spherical shape or the like. The body 6 is covered by a similar material, as is the arm structure 4, such as a polyester which is filled with soft material. Generally, the body 6 may be constructed by stitching two pieces of material together along its edges 6*a*.

The length of the arm structure 4 is selected to be three, four or more times the longest dimension of the body 6 in order to perform the objectives of the invention. The head is formed as a soft sculpture, such as a nylon with a pliable fill material, on which facial features may be formed and retained after formation. Such soft sculpture fill materials are well known in the art. The cap 10 is affixed to the head by sewing and the like. Hair 16 and beard 18 may be depicted on the face by attachment of a suitable material, such as chenille. Eyes 20 and glasses 22 comprise any commercially available items of appropriate design for retention on the head.

The arm structure 4 performs several functions involving the pair of arm portions 30 that are pivotally attached to body 6 at stitching 14. The length of the arm structure 4 allows the stuffed FIG. 2 to assume a multitude of configurations. In one position, the arms may be wrapped around the body in a self hugging gesture and also provide a spacing saving configuration for ease and economy of packaging and transport. The arm portions 30 may be affixed together by any fastener in the self hugging position through pins, Velcro fasteners, snaps, and the like. One or both arms 30 may be positioned outward from the body 6 in a wide range of different positions (not shown), but which positions should be apparent to one skilled in the art. Also, the arms may assume an arm-folded position in front of body 6. Finally, both arms may encircle any object, such as the bottle of FIG. 1, for a decorative effect, particularly desirable for gift giving and the like. The arm portions 30 may be attached together at hands 12 for retention by pins, Velcro fasteners, and the like (not shown). In all positions of arm portions 30, the bottom portions of the arm structure 4 stabilize and maintain the head and body of the stuffed figure upright without external supports. The self-supporting ability of the FIG. 2 is aided by the fact that the surface contacting bottom of body 6 and arms 30 lie approximately in the same plane.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A stuffed figure comprising a body having a continuous outer cloth covering and a soft filler material retained with the covering;

an elongated one piece arm structure having handlike designs attached at each end, said arm structure having a continuous outer cloth covering and a filler material retainer therein;

said arm structure having an end to end length at least three times greater than the greatest dimensional width of the body;

said arm structure being pivotally attached to said body at a midportion of said arm structure to form two freely swingable arms capable of assuming a multitude of positions;

said arm structure and said body each having a bottom portion lying generally in the same plane;

a head attached to an upper portion of said body; and said arm structure and said body cooperating to maintain said body and said head in a generally upright position in substantially all positions of said arms.

2. The figure according to claim 1 wherein said arm structure is sewn to said body at a portion of said body without filler material.

3. The figure according to claim 2 wherein said arm structure is generally affixed to said body along an axis created by a stitching.

* * * * *